US009644597B2

(12) United States Patent
Torazawa

(10) Patent No.: US 9,644,597 B2
(45) Date of Patent: May 9, 2017

(54) CERAMIC GLOW PLUG

(71) Applicant: NGK SPARK PLUG CO., LTD., Nagoya-shi, Aichi (JP)

(72) Inventor: Masahiro Torazawa, Aichi (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 532 days.

(21) Appl. No.: 14/233,049

(22) PCT Filed: Sep. 25, 2012

(86) PCT No.: PCT/JP2012/006111

§ 371 (c)(1),
(2) Date: Jan. 15, 2014

(87) PCT Pub. No.: WO2013/046650

PCT Pub. Date: Apr. 4, 2013

(65) Prior Publication Data

US 2014/0196680 A1 Jul. 17, 2014

(30) Foreign Application Priority Data

Sep. 27, 2011 (JP) ..... 2011-211145

(51) Int. Cl.

| | |
|---|---|
| ***F23Q 7/00*** | (2006.01) |
| ***F02P 19/02*** | (2006.01) |
| ***H05B 3/48*** | (2006.01) |

(52) U.S. Cl.

CPC ..... *F02P 19/02* (2013.01); *F23Q 7/001* (2013.01); *H05B 3/48* (2013.01); *H05B 2203/027* (2013.01)

(58) Field of Classification Search

CPC ..... F23Q 7/001; H05B 2203/027

(Continued)

(56) References Cited

U.S. PATENT DOCUMENTS 5,852,280 A * 12/1998 Mizuno ..... F23Q 7/001 123/145 A
6,881,930 B2 * 4/2005 Yoshikawa ..... F23Q 7/001 123/145 A (Continued)

FOREIGN PATENT DOCUMENTS

JP 2002-299009 A 10/2002
JP 2002-364842 A 12/2002

(Continued)

OTHER PUBLICATIONS

Communication dated Jan. 27, 2015, issued by the European Patent Office in corresponding European Application No. 12835782.9.

*Primary Examiner* — Marguerite McMahon
*Assistant Examiner* — James Kim
(74) *Attorney, Agent, or Firm* — Sughrue Mion, PLLC

(57) ABSTRACT

A ceramic glow pug has a structure in which a portion of an embedded resistor is exposed on a portion of a substrate and forms an exposed surface of an electrode taking-out portion. The resistor formed of an electrically conductive ceramic is embedded in the substrate formed of an electrically insulating ceramic, and a portion of the resistor is exposed on the surface of the substrate and has an exposed surface. The exposed surface and the embedded portion differ in stress acting on the substrate, which may decrease the breakage resistance in the vicinity of the electrode taking-out portion. The shape of the exposed surface is such that dimensions, in the axial and circumferential directions, fall within a range of 1.0 mm to 1.8 mm.

4 Claims, 5 Drawing Sheets

(58) Field of Classification Search
USPC ..... 123/145 A; 219/277, 544
See application file for complete search history.

(56) References Cited

U.S. PATENT DOCUMENTS

| | | | | |
|---|---|---|---|---|
| 7,223,942 | B2 * | 5/2007 | Konishi | F23Q 7/00 123/179.6 |
| 2004/0178185 | A1 * | 9/2004 | Yoshikawa | F23Q 7/001 219/270 |
| 2006/0011602 | A1 | 1/2006 | Konishi et al. | |
| 2007/0210053 | A1 * | 9/2007 | Hotta | F23Q 7/001 219/270 |
| 2009/0008383 | A1 * | 1/2009 | Kurono | F23Q 7/001 219/553 |
| 2009/0194519 | A1 * | 8/2009 | Funaki | F23Q 7/001 219/270 |
| 2010/0213188 | A1 * | 8/2010 | Nishihara | F23Q 7/001 219/544 |
| 2011/0114622 | A1 * | 5/2011 | Sekiguchi | F23Q 7/001 219/270 |
| 2013/0160730 | A1 * | 6/2013 | Kan | F23Q 7/001 123/145 A |
| 2013/0313244 | A1 * | 11/2013 | Matsui | H05B 3/44 219/270 |

FOREIGN PATENT DOCUMENTS

| | | | |
|---|---|---|---|
| JP | 2006-49279 | A | 2/2006 |
| JP | 2007-240080 | A | 9/2007 |

* cited by examiner

CERAMIC GLOW PLUG

CROSS REFERENCE TO RELATED APPLICATIONS

This application is a National Stage of International Application No. PCT/JP2012/006111, filed on Sep. 25, 2012, which claims priority from Japanese Patent Application No. 2011-211145, filed on Sep. 27, 2011, the contents of all of which are incorporated herein by reference in their entirety.

TECHNICAL FIELD

The present invention relates to a rod-shaped ceramic heater in which a heat-generating element formed of an electrically conductive ceramic is embedded and held in a substrate formed of an electrically insulating ceramic, and to a glow pug which includes such a ceramic heater. More particularly, the present invention relates to a ceramic glow plug which has an electrode taking-out portion which extends radially outward from a rod-shaped lead portion connected to the heat-generating element and embedded in the substrate and which is exposed on the outer circumferential surface of the ceramic heater, the ceramic glow plug having a structure in which the electrode taking-out portion is electrically connected to the inner circumferential surface of a metal outer sleeve which tightly holds the ceramic heater from the radially outer side thereof.

BACKGROUND ART

Conventionally, a glow pug used for, for example, assisting startup of a diesel engine includes a tubular metallic shell, a rod-shaped center shaft, a heater including a heat-generating element which generates heat when energized, an insulating member, an outer sleeve, a connection terminal, etc. In view of the required performance of diesel engines and costs, there have been used a metal glow pug which includes a sheathed heater having a metal sheath, and a ceramic glow plug which includes a ceramic heater.

Incidentally, such a ceramic glow plug generally has the following structure. Namely, a center shaft is disposed inside a metallic shell such that its one end projects toward the rear end side, and a ceramic heater (hereinafter, may be simply referred to as a "heater") is provided on the forward end side of the center shaft. Also, an outer sleeve formed of metal is joined to a forward end portion of the metallic shell, and the heater is held by the outer sleeve. Meanwhile, on the rear end side of the metallic shell, an insulating member is inserted between the center shaft and the metallic shell. On the rear end side of the insulating member, a connection terminal is fixed to the center shaft in a state in which the connection terminal pushes the insulating member toward the forward end side. Preferably, a method of press-fitting the heater into the outer sleeve is used to hold the heater. At that time, there may be used a method of applying a lubricant to the heater so as to facilitate the press fitting, and removing the lubricant by heating after completion of the press fitting. Thus, a radially inward force from the outer sleeve acts on the heater, whereby the heater is firmly constricted and held.

The above-described ceramic heater is formed by embedding and holding a heat-generating element formed of an electrically conductive ceramic in a substrate formed of an electrically insulating ceramic. In this case, electrode taking-out portions of negative and positive poles used for applying a voltage to the heat-generating element are provided at the rear end side of the ceramic heater. One electrode taking-out portion is electrically connected to the metallic shell, and the other electrode taking-out portion is electrically connected to the center shaft (see, for example, Patent Document 1). These electrical connections are realized by the above-mentioned press fitting. The two electrode taking-out portions are connected to opposite end portions of the heat-generating element through a pair of rod-shaped lead portions. Similar to the heat-generating element, the two electrode taking-out portions and the pair of lead portions are formed from an electrically conductive ceramic (see, for example, Patent Document 2). Hereinafter, the electrode taking-out portions, the lead portions, and the heat-generating element may be collectively referred to as a "resistor."

PRIOR ART DOCUMENTS

Patent Documents

Patent Document 1: Japanese Patent Application Laid-Open (kokai) No. 2002-364842

Patent Document 2: Japanese Patent Application Laid-Open (kokai) No. 2007-240080

SUMMARY OF THE INVENTION

Problems to be Solved by the Invention

In order to render the resistor electrically conductive, the resistor is formed of a material which contains a metal component such as W (tungsten) or Mo (molybdenum) in a larger amount as compared with the substrate. Therefore, the resistor has a coefficient of thermal expansion greater than that of the substrate. Since the resistor and the substrate have different coefficients of thermal expansion, in a cooling step of a process of firing the ceramic heater, the resistor shrinks more than does the substrate. Accordingly, a thermal stress (tensile stress) is produced in the substrate such that the substrate shrinks in the axial direction. As a result, a compressive stress acts on the surface of the heater. Therefore, the apparent strength of the heater increases by an amount corresponding to the acting compressive stress, as compared with a sintered body of a substrate material in which no resistor is present.

If the resistor is uniformly present along the axial direction of the heater, an increase in strength caused by the action of the above-mentioned compressive stress can be used favorably. However, the electrode taking-out portions are formed to be exposed on the outer circumference surface of the heater. Therefore, tensile stresses from the exposed portions of the electrode taking-out portions act on portions of the substrate around the electrode taking-out portions (hereinafter, these portions will be also referred to as "electrode portions"). As a result, the effect of increasing the strength of the heater by the above-mentioned compressive stress is cancelled out, whereby the electrode portions become lower in strength than the remaining portion.

Incidentally, in order to remove a lubricant used when the heater is press-fitted into the outer sleeve, an assembly of the heater and the outer sleeve is heated to about 300° C. Since the outer sleeve is formed of metal, its coefficient of thermal expansion is far greater than that of the ceramic heater. Therefore, the outer sleeve thermally expands as a result of heating for removal of the lubricant. Of the thermal expansion of the outer sleeve, the expansion in the axial direction produces a tensile stress in the axial direction of the heater. At that time, the heater receives the radially inward compressive stress produced as a result of the above-mentioned press fitting and the tensile stress in the axial direction. Since the electrode portions of the heater are low in strength as described above, the compressive stress and the tensile stress synergistically acting on the electrode portions may cause the ceramic heater to break from the electrode portions (starting points).

A possible way to prevent such breakage is weakening the force with which the outer sleeve constricts the heater, through selection of the shape of the outer sleeve, the designed diameter difference provided between the outer sleeve and the heater for press-fitting of the heater, and the material of the outer sleeve. However, when the tolerances of components are decreased, productivity may be impaired, and problems such as electrical connection failure may arise. Therefore, weakening the force with which the outer sleeve constricts the heater is impractical. Therefore, there has been demanded a technique of increasing the strength of the heater itself.

Notably, the above-described problem occurs not only in ceramic glow plugs in which a heater is press-fitted into an outer sleeve and is held thereby, but also in ceramic glow plugs in which a heater is held by an outer sleeve via a brazing material layer.

In view of such circumstances, the present invention provides a glow pug in which an outer sleeve formed of metal holds a ceramic heater composed of a substrate and a resistor having different coefficients of thermal expansion. The glow plug has been improved in resistance to breakage of the ceramic heater at electrode portions, which would otherwise occur after being combined with the outer sleeve, without changing the constituent material of the heater or changing the dimensions, material, etc. of the outer sleeve and without impairing the electrical connection between the heater and the outer sleeve through an electrode taking-out portion.

Means for Solving the Problems

Configuration 1. In order to solve the above-described problems, a ceramic glow plug of the present invention comprises:

a ceramic heater composed of a substrate formed of an electrically insulating ceramic and having a columnar shape extending in an axial direction, and a resistor having a heat-generating element formed of an electrically conductive ceramic, embedded in a forward end portion of the substrate, and generating heat by resistance heating when energized, lead portions connected to opposite end portions of the heat-generating element and extending rearward in the axial direction, and an electrode taking-out portion extending in a radial direction from at least one of the lead portions and exposed on an outer circumferential surface of the substrate; and a metallic tubular member in which the ceramic heater is held and which is in contact with an exposed surface of the electrode taking-out portion and electrically conducts with the exposed surface, the ceramic glow plug being characterized in that dimensions, in the axial and circumferential directions, of the exposed surface of the electrode taking-out portion both fall within a range of 1.0 mm to 1.8 mm.

Configuration 2. The ceramic glow plug of the present invention is characterized in that the ratio of a compressive residual stress in each of a specific region of the substrate which is separated 0.3 mm from a forward end of the exposed surface of the electrode taking-out portion and a specific region of the substrate which is separated 0.3 mm from a rear end of the exposed surface to a compressive residual stress in a portion of the substrate other than the specific regions is 50% or higher.

Configuration 3. The ceramic glow plug of the present invention is characterized in that the dimension of the exposed surface of the electrode taking-out portion measured in the axial direction is smaller than that measured in the circumferential direction.

Configuration 4. The ceramic glow plug of the present invention is characterized in that the shape of the exposed surface of the electrode taking-out portion does not have corner portions.

Configuration 5. The ceramic glow plug of the present invention is characterized in that the ceramic heater is press-fitted into the tubular member.

Effects of the Invention

According to the ceramic glow plug of the above-described configuration 1, the following advantageous effect is obtained. Even when the resistor and the substrate differ in coefficient of thermal expansion, by setting the axial and circumferential dimensions of the exposed surface of the electrode taking-out portion to fall within the range of 1.0 mm to 1.8 mm, the resistance to breakage of the ceramic heater can be improved without impairing the electrical connection between the electrode taking-out portion and the tubular member. In particular, the above-described effect becomes more remarkable when the difference between the coefficient of thermal expansion of the resistor and the coefficient of thermal expansion of the substrate is 0.3 ppm/K or greater.

According to the ceramic glow plug of the above-described configuration 2, the ratio between the compressive residual stress in the specific regions of the substrate and the compressive residual stress in a portion of the substrate other than the specific regions (the compressive residual stress of the substrate in the specific regions/the compressive residual stress of the substrate in the portion other than the specific regions) is 50% or higher. Therefore, the strength of the substrate around the exposed surface can be increased.

According to the ceramic glow plug of the above-described configuration 3, the dimension of the exposed surface of the electrode taking-out portion measured in the axial direction is made smaller than that measured in the circumferential direction. Therefore, the resistance to breakage of the ceramic heater can be improved further.

According to the ceramic glow plug of the above-described configuration 4, the shape of the exposed surface of the electrode taking-out portion does not have corner portions. Therefore, occurrence of local stress concentration can be avoided, whereby the strength of the substrate around the exposed surface can be increased to a greater extent.

In a ceramic glow plug in which the ceramic heater is press-fitted into the tubular member, it is difficult to simultaneously realize the maintenance of electrical connection between the electrode taking-out portion and the tubular member and the resistance to breakage of the ceramic heater. Therefore, the above-described configurations 1 to 4 are particularly effective in the ceramic glow plug of the configuration 5.

MODE FOR CARRYING OUT THE INVENTION

Figure 1:
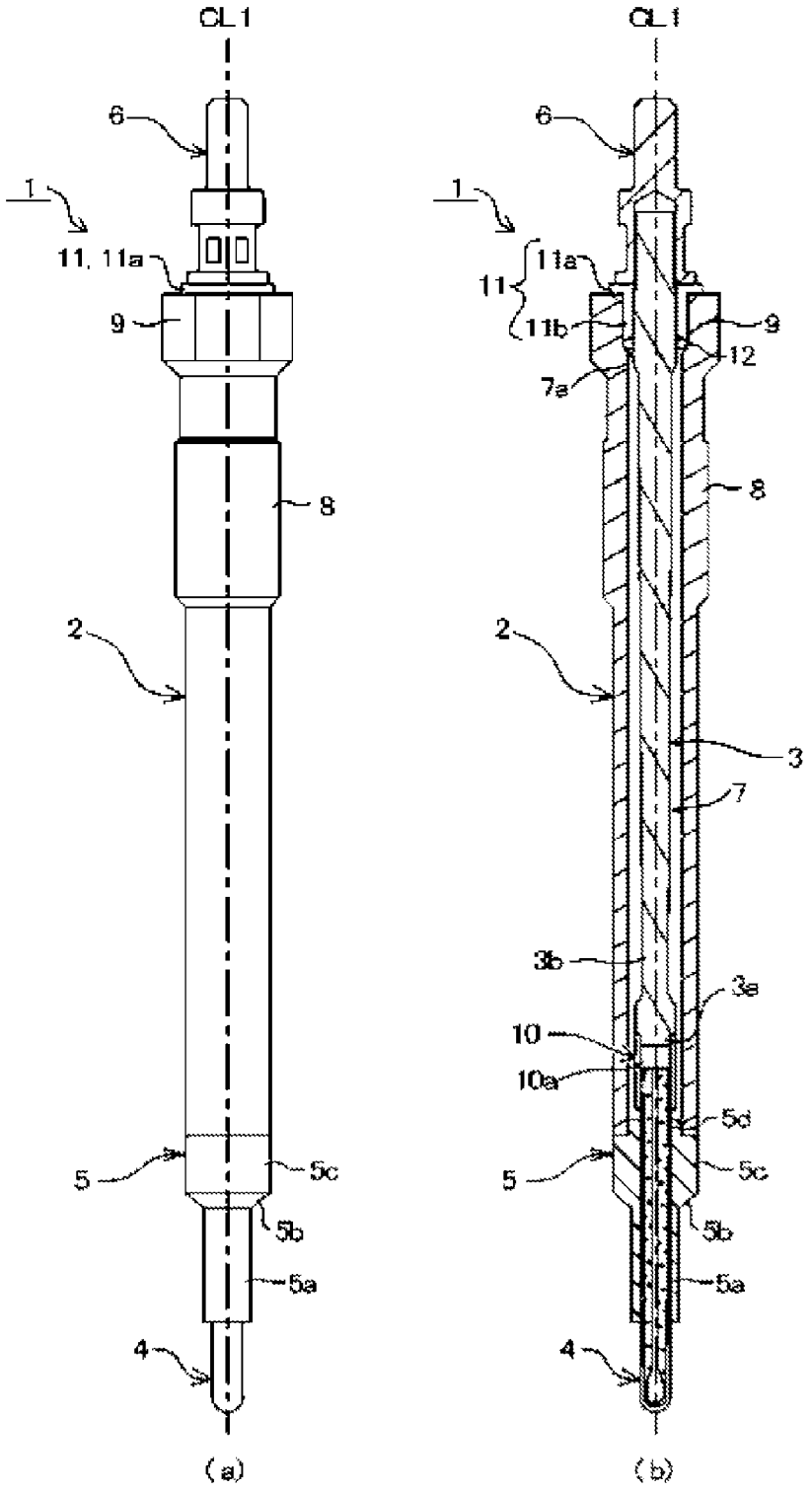
FIG. 1 Views showing a ceramic glow plug of the present invention, wherein (a) shows a front view and (b) shows a vertical cross-sectional view.
Figure 2:
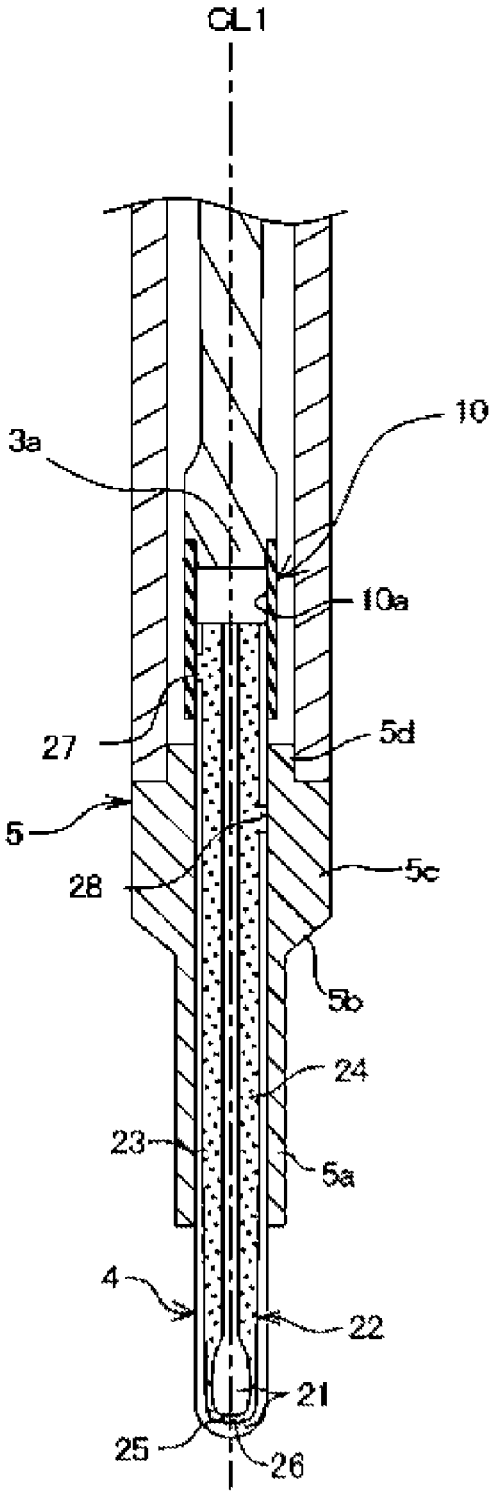
FIG. 2 Fragmentary, enlarged, sectional view of the glow plug which mainly shows a ceramic heater.

One embodiment will now be described with reference to the drawings. First, a ceramic glow plug 1 (hereinafter referred to as the "glow pug 1") which includes a ceramic heater 4 according to the present invention will be described with reference to FIGS. 1(*a*), 1(*b*), and 2. FIG. 1(*a*) is a front view of the glow pug 1, and FIG. 1(*b*) is a vertical cross-sectional view of the glow pug 1. FIG. 2 is a fragmentary, enlarged, sectional view mainly showing the ceramic heater 4. In description with reference to FIGS. 1(*a*), 1(*b*), and 2, the lower side of the glow plug 1 (the ceramic heater 4) is referred to as the forward end side of the glow plug 1, and the upper side as the rear end side of the glow plug 1.

As shown in FIGS. 1(*a*) and 1(*b*), the glow plug 1 includes a metallic shell 2, a center shaft 3, the ceramic heater 4, an outer sleeve 5, and a connection terminal 6.

The metallic shell 2 is formed of a predetermined metal material (e.g., an iron-based material, such as S45C) and has an axial bore 7 extending along the direction of an axis CL1. At the rear end of the axial bore 7, a taper portion 7*a* is formed such that the inner diameter decreases toward the forward end side. A portion of the axial bore 7 located on the forward end side with respect to the taper portion 7*a* is formed to be straight (to have a constant inner diameter). Furthermore, an externally threaded portion 8 is formed on the outer circumference of a longitudinally central portion of the metallic shell 2. The externally threaded portion 8 is used to mount the glow plug 1 to an internally threaded portion formed on the wall surface of a mounting hole of the cylinder head of an engine. Also, a flange-like tool engagement portion 9 having a hexagonal cross section is formed on the outer circumference of a rear end portion of the metallic shell 2. When the glow plug 1 (the externally threaded portion 8) is to be mounted to the mounting hole, a tool to be used is engaged with the tool engagement portion 9.

The axial bore 7 of the metallic shell 2 accommodates the center shaft 3 made of metal and having a round rodlike shape. At the forward end of the center shaft 3, a forward end small diameter portion 3*a* is formed such that it has a diameter smaller than that of a rear end portion of the center shaft 3. The center shaft 3 is connected to a rear end portion of the ceramic heater 4 via a cylindrical ring member 10 formed of a metal material (e.g., an iron-based material, such as SUS). Specifically, a rear end portion of the ceramic heater 4 is press-fitted into a forward end portion of an inner hole 10*a* of the ring member 10. The forward end small diameter portion 3*a* is fitted into a rear end portion of the inner hole 10*a* of the ring member 10. In this state, the center shaft 3 and the ring member 10 are joined to each other by laser welding or the like. Thus, the center shaft 3 and the ceramic heater 4 are mechanically and electrically connected to each other via the ring member 10.

Meanwhile, the above-mentioned connection terminal 6 made of metal is fixedly crimped to a rear end portion of the center shaft 3. An electrically insulating bushing 11 formed of an electrically insulating material is disposed between a forward end portion of the connection terminal 6 and a rear end portion of the metallic shell 2 in order to prevent direct electrical conduction therebetween. Specifically, the electrically insulating bushing 11 has a flange portion 11*a* which is formed on the rear end side thereof and projects radially outward, and a small diameter portion 11*b* which is formed on the forward end side thereof and has a diameter smaller than that of the flange portion 11*a*. The electrically insulating bushing 11 is provided in a state in which the small diameter portion 11*b* is fitted into a rear end portion of the axial bore 7, and the flange portion 11*a* is sandwiched between the connection terminal 6 and the metallic shell 2. An O-ring 12 formed of an electrically insulating material is provided between the metallic shell 2 and the center shaft 3 in such a manner as to be in contact with the taper portion 7*a* in order to improve gastightness within the axial bore 7.

The center shaft 3 has a thin portion 3*b* whose outer diameter is reduced toward the forward end thereof. The thin portion 3*b* mitigates the stress transferred to the center shaft 3.

The outer sleeve 5 is formed into a cylindrical shape from a predetermined metal material (e.g., SUS310). The outer sleeve 5 holds an intermediate portion, along the direction of the axis CL1, of the ceramic heater 4. A forward end portion of the ceramic heater 4 projects from the forward end of the outer sleeve 5. The outer sleeve 5 has a small diameter portion 5*a* formed on the forward end side thereof and having a relatively small wall thickness; a taper portion 5*b* formed rearward of the small diameter portion 5*a* and tapered such that its outer diameter decreases toward the forward end side; a large diameter portion 5*c* formed continuously from the rear end of the taper portion 5*b* and having an outer diameter approximately equal to the outer diameter of the forward end of the metallic shell 2; and an engagement portion 5*d* formed rearward of the large diameter portion 5*c* and having an outer diameter approximately equal to the inner diameter of a forward end portion of the axial bore 7. In a state in which the engagement portion 5*d* is fitted into the forward end portion of the axial bore 7, a fusion portion is formed by laser welding or the like at the contact interface between the metallic shell 2 and the outer sleeve 5, whereby the outer sleeve 5 is joined to the metallic shell 2. Notably, when the glow plug 1 is attached to an internal combustion engine, the taper portion 5*b* serves as a seal for securing the gastightness of a combustion chamber.

Next, the ceramic heater 4 will be described in detail with reference mainly to FIG. 2. The ceramic heater 4 includes the round rodlike substrate 21 which has a generally constant diameter. The substrate 21 is formed of an electrically insulating ceramic and extending in the direction of the axis CL1. An elongated U-shaped resistor 22 formed of an electrically conductive ceramic is embedded and held in the substrate 21. The ceramic heater 4 has an outer diameter of, for example, 2.5 mm to 4.0 mm. The resistor 22 includes a pair of rod-shaped lead portions 23 and 24, and a connection portion 25 which connects together forward end portions of the lead portions 23 and 24. The connection portion 25, in particular, a forward end portion thereof, serves as a heat-generating portion 26. The heat-generating portion functions as a so-called heat-generating resistor and has a shape resembling the letter U so as to follow the curved surface of a curved forward end portion of the ceramic heater 4. In the present embodiment, the cross-sectional area of the heat-generating portion 26 is made smaller than those of the lead portions 23 and 24. Therefore, when the ceramic heater 4 is energized, heat is intensively generated at the heat-generating portion 26. Notably, the connection portion 25 corresponds to the heat-generating element in the present invention. In the present embodiment, $Si_3N_4$ (silicon nitride) is mainly used as the electrically insulating ceramic material which forms the substrate 21. Also, an electrically conductive ceramic material (material which has electrical conductivity after firing) which contains silicon nitride as a main component and contains WC (tungsten carbide) (e.g., in an amount of 60 to 70 mass % when the total amount of silicon nitride and tungsten carbide is considered 100 mass %) is used as a material for forming the resistor 22. The coefficient of thermal expansion of the substrate 21 is, for example, 3.3 to 4.0 ppm/K, and the coefficient of thermal expansion of the resistor 22 is, for example, 3.6 to 4.2 ppm/K.

The lead portions 23 and 24 extend toward the rear end of the ceramic heater 4 substantially in parallel with each other. One lead portion 23 has an electrode taking-out portion 27 located toward its rear end and projecting radially outward. The electrode taking-out portion 27 is exposed on the outer circumferential surface of the ceramic heater 4. Similarly, the other lead portion 24 has an electrode taking-out portion 28 located toward its rear end and projecting radially outward. The electrode taking-out portion 28 is exposed on the outer circumferential surface of the ceramic heater 4. The electrode taking-out portion 27 of the one lead portion 23 is located rearward of the electrode taking-out portion 28 of the other lead portion 24 with respect to the direction of the axis CL1.

Additionally, the exposed portion of the electrode taking-out portion 27 is in contact with the inner circumferential surface of the ring member 10, thereby establishing electrical conduction between the lead portion 23 and the center shaft 3 connected to the ring member 10. Also, the exposed portion of the electrode taking-out portion 28 is in contact with the inner circumferential surface of the outer sleeve 5, thereby establishing electrical conduction between the lead portion 24 and the metallic shell 2 connected to the outer sleeve 5. Namely, in the present embodiment, the center shaft 3 and the metallic shell 2 function as a positive pole and a negative pole for supplying power to the heat-generating portion 26 of the ceramic heater 4 in the glow plug 1. The electrode taking-out portion 28, which is the main portion of the present invention, will be described after the description of a manufacturing method together with evaluation results.

Notably, the above-described glow pug 1 is mounted to a mounting hole of the cylinder head of an internal combustion engine. At that time, the outer sleeve 5 comes into contact with the cylinder head, whereby the metallic shell 2 is grounded.

Next, a method of manufacturing the above-described glow plug 1 will be described. For those members whose manufacturing methods are not particularly mentioned herein, conventionally known manufacturing methods are employed.

First, a pipe formed of an iron-based material such as SUS630 is cut to a predetermined length, and the resultant member is formed to have a predetermined cylindrical shape, whereby the ring member 10 is formed. In addition, a pipe formed of a predetermined metal material (e.g., SUS430) is cut, and cutting is performed on the resultant member so as to form the outer sleeve 5 having the above-mentioned small diameter portion 5*a*, taper portion 5*b*, etc. Further, plating such as Au plating is applied to the surfaces of the ring member 10 and the outer sleeve 5.

After that, a rear end portion of the ceramic heater 4 manufactured separately is press-fitted into a forward end portion of the inner hole 10*a* of the ring member 10. In addition, the ceramic heater 4 is press-fitted into the inner hole of the outer sleeve 5. At that time, the outer sleeve 5 is fixed such that it is separated from the ring member 10 in the direction of the axis CL1 to thereby be prevented from contacting the ring member 10. Notably, when the ceramic heater 4 is press-fitted into the outer sleeve 5, PASKIN M30 (product name: Kyoeisha Chemical Co., Ltd.) is applied in a proper amount as a lubricant. An assembly of the ceramic heater 4 and the outer sleeve 5 united by press-fitting is placed in a heating furnace, and is heated to about 300° C. so as to decompose and remove the lubricant.

Next, the center shaft 3 manufactured in advance is fitted into a rear end portion of the inner hole 10*a*. In this state, a laser beam is applied along the contact interface between the ring member 10 and the center shaft 3 so as to join the ring member 10 and the center shaft 3 together. As a result, the center shaft 3, the ceramic heater 4, the outer sleeve 5, and the ring member 10 are united together.

Separately, the metallic shell 2 is manufactured. Namely, a pipe formed of a predetermined metal material is cut, and cutting or rolling is performed on the resultant member so as to form the metallic shell 2 having the externally threaded portion 8 and the tool engagement portion 9. If necessary, a rustproofing treatment such as plating may be performed.

Next, the outer sleeve 5 with which the center shaft 3, the ceramic heater 4, etc. have been united is joined to the metallic shell 2. Namely, in a state in which the engagement portion 5*d* of the outer sleeve 5 is fitted into the axial bore 7 of the metallic shell 2, a laser beam is applied along the contact interface between the outer sleeve 5 and the metallic shell 2. As a result, the above-mentioned fusion portion is formed, whereby the outer sleeve 5 united with the center shaft 3, the ceramic heater 4, etc. is joined to the metallic shell 2.

Finally, in a state in which the electrically insulating bushing 11 and the O-ring 12 are disposed at predetermined positions between the metallic shell 2 and the center shaft 3, the previously formed connection terminal 6 is fixed, by means of crimping, to a rear end portion of the center shaft 3 projecting from the rear end of the metallic shell 2, whereby the glow pug 1 is obtained.

Figure 3:
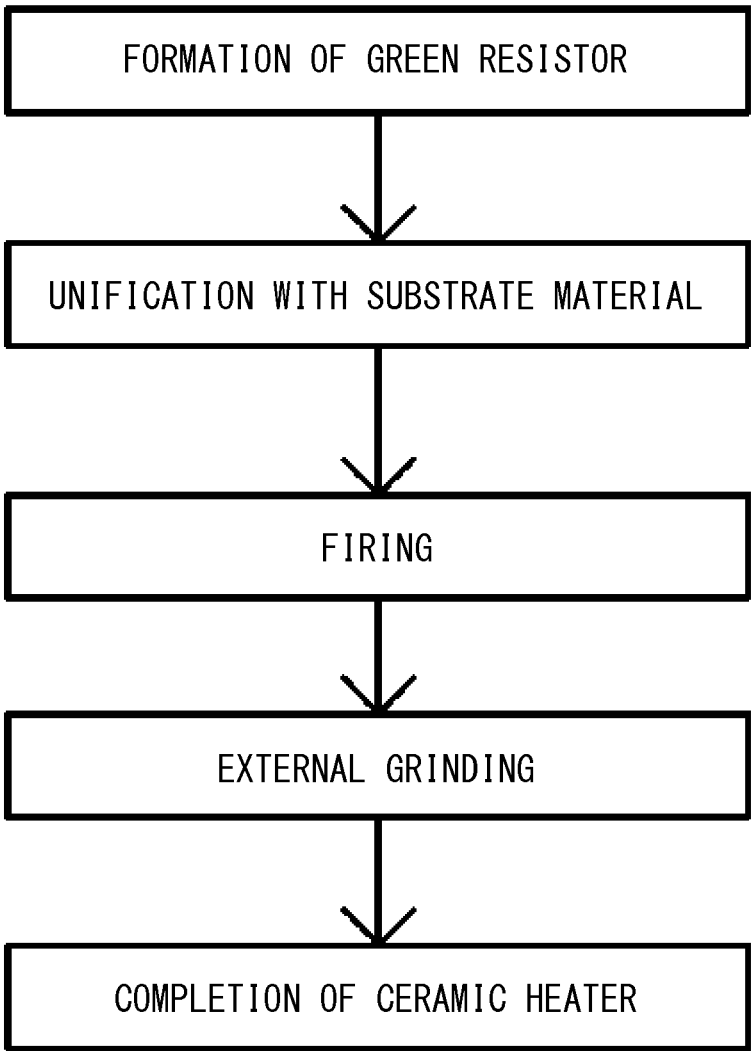
FIG. 3 Flowchart showing the steps of a method of manufacturing the ceramic heater.

Here, a method of manufacturing the ceramic heater 4 will be described. Although the ceramic heater 4 of the present invention is unique in terms of the shape of the electrode taking-out portion 28, the remaining configuration can be formed through use of a conventional manufacturing method. Therefore, the ceramic heater 4 is manufactured through a series of steps; i.e., a step of forming a green resistor, a step of uniting the green resistor with a substrate material, a step of firing, and a step of external grinding (see FIG. 3).

The ceramic heater 4 shrinks and deforms in the step of firing (e.g., hot press). Therefore, when a green resistor (a resistor before firing) is manufactured by injection molding, the green resistor is formed in consideration of the shrinkage, etc. such that the shape of the electrode taking-out portions to be described later is obtained.

The ceramic glow plug of the present invention manufactured in this manner realizes a good electrical connection between the ceramic heater and the outer sleeve, and has an excellent breakage resistance. Next, evaluation tests performed for the ceramic glow plug of the present invention, and their results will be described.

Each of test samples of the ceramic heater manufactured in the above-described manner had an outer diameter of 3.1 mm and a length of 42 mm. Notably, the exposed surfaces of the electrode taking-out portions of each of the manufactured test samples have a circular shape or an elliptical shape. Namely, in the present invention, the exposed surfaces have no corner portion. The dimensions of each exposed surface were set such that the maximum length in the axial direction was set to one of five dimensions (axial dimensions) of 0.5 mm, 1.0 mm, 1.8 mm, 2.0 mm, and 3.0 mm, and the maximum length in the circumferential direction was set to one of five dimensions (circumferential dimensions) of 0.5 mm, 1.0 mm, 1.8 mm, 2.0 mm, and 3.0 mm. The evaluation tests were carried out in 25 patterns in total (25 combinations of the five axial dimensions and the five circumferential dimensions). The outer sleeve used in ceramic glow plugs manufactured for the evaluation tests was such that the large diameter portion to come into contact with the corresponding electrode taking-out portion of the ceramic heater had an outer diameter of 8.0 mm, an inner diameter of 3.05 mm, and a length of 25 mm, and a portion of the large diameter portion having the maximum outer diameter had an axial length of 4.0 mm.

In addition to the breakage resistance of the heater, occurrence of a resistor failure in the heater was checked as an evaluation item. Respective test methods are as follows.

[Incidence of Breakage Failure of Heater]

The ceramic heater was press-fitted into the above-described outer sleeve, and the lubricant was heated and removed. The heater was cooled to room temperature, and the heater was checked so as to determine whether or not breakage of the heater had occurred. The number of broken heaters was counted, and a breakage failure incidence was calculated. Table 1 shows the results of this evaluation test. Notably, the lubricant was removed by a method of heating the heater to 300° C. by using an atmospheric heating furnace and then naturally cooling the heater to room temperature.

[Incidence of Resistor Failure Due to Drop]

The ceramic heater was press-fitted into the outer sleeve in the same procedure as in the above-described breakage failure test. Glow plugs were manufactured in the above-described procedure through use of unbroken ceramic heaters. Each of the completed ceramic glow plugs was dropped to a concrete floor from a height of 50 cm. After that, the resistance of each ceramic glow plug was measured by supplying electricity thereto. The number of test samples whose resistances increased 20% or more from those before dropping; i.e., the designed resistance, was counted, and a resistor failure incidence was calculated. Table 2 shows the results of this evaluation test. Notably, in both the tables showing the results of the two tests, symbol "AA" shows that the failure incidence is 0.1% or less, "BB" shows that the failure incidence is not less than 0.1% but less than 1%, and "CC" shows that the failure incidence is 1% or greater. In each test, 300 test samples were evaluated. Therefore, in the present evaluation tests, symbol "AA" shows that failure occurred in no test sample, symbol "BB" shows that failure occurred in one or two test samples, and symbol "CC" shows that failure occurred in three or more test samples.

TABLE 1

| Evaluation of heater breakage resistance | | Axial length of exposed surface (mm) 0.5 | 1.0 | 1.5 | 1.8 | 2.0 | 3.0 |
|---|---|---|---|---|---|---|---|
| Circumferential length of exposed surface (mm) | 0.5 | AA | AA | AA | AA | AA | BB |
| | 1.0 | AA | AA | AA | AA | BB | CC |
| | 1.5 | AA | AA | AA | AA | BB | CC |
| | 1.8 | AA | AA | AA | AA | BB | CC |
| | 2.0 | AA | BB | BB | BB | BB | CC |
| | 3.0 | BB | BB | BB | BB | BB | CC |

TABLE 2

| Evaluation of resistor failure | | Axial length of exposed surface (mm) 0.5 | 1.0 | 1.5 | 1.8 | 2.0 | 3.0 |
|---|---|---|---|---|---|---|---|
| Circumferential length of exposed surface (mm) | 0.5 | CC | BB | BB | BB | BB | BB |
| | 1.0 | CC | AA | AA | AA | AA | AA |
| | 1.5 | CC | AA | AA | AA | AA | AA |
| | 1.8 | CC | AA | AA | AA | AA | AA |
| | 2.0 | CC | AA | AA | AA | AA | AA |
| | 3.0 | CC | AA | AA | AA | AA | AA |

As shown in these results, it was found about heater breakage failure that when the shape of the exposed surface of the electrode taking-out portion is such that each of the axial and circumferential lengths is 1.8 mm or less, the failure incidence is very low, and no problem occurs. Also, it was found about resistor failure that when the shape of the exposed surface of the electrode taking-out portion is such that each of the axial and circumferential lengths is 1.0 mm or greater, resistor failure does not occur. Notably, it was confirmed that results similar to the above-described results are obtained when the ceramic heater has an outer diameter of 2.5 to 4.0 mm.

[Checking of Dependency on Heater Outer Diameter]

The dependency on the outer diameter of the heater in the evaluation tests was checked. An evaluation method is identical to that employed in the above-described test for checking the incidence of breakage failure. There were prepared six types of test samples; i.e., Examples 1 to 3 in which the shape of the exposed surface of each electrode taking-out portion was determined such that the exposed surface had an axial length of 1.7 mm and a circumferential length of 1.0 mm and in which the heater had an diameter of 3.1 mm, 3.3 mm, and 3.5 mm, respectively; and Comparative Examples 1 to 3 in which the shape of the exposed surface of each electrode taking-out portion was determined such that the exposed surface had an axial length of 2.0 mm and a circumferential length of 2.0 mm and in which the heater had an diameter of 3.1 mm, 3.3 mm, and 3.5 mm, respectively. An evaluation test was performed for these test samples. Table 3 shows the results of this evaluation test.

TABLE 3

| Dependency on heater outer diameter | Heater main portion dimensions (mm) Axial direction | Circumferential direction | Heater outer diameter | Breakage failure |
|---|---|---|---|---|
| Example 1 | 1.7 | 1.0 | 3.1 | AA |
| Example 2 | 1.7 | 1.0 | 3.3 | AA |
| Example 3 | 1.7 | 1.0 | 3.5 | AA |
| Comparative Example 1 | 2.0 | 2.0 | 3.1 | BB |
| Comparative | 2.0 | 2.0 | 3.3 | BB |

TABLE 3-continued

| Dependency on heater outer diameter | Heater main portion dimensions (mm) Axial direction | Circumferential direction | Heater outer diameter | Breakage failure |
|---|---|---|---|---|
| Example 2 | | | | |
| Comparative Example 3 | 2.0 | 2.0 | 3.5 | AA |

This evaluation test revealed the meaningfulness of setting the shape of the exposed surface of the electrode taking-out portion such that each of the axial and circumferential lengths become 1.0 mm to 1.8 mm, irrespective of the outer diameter of the ceramic heater. Specifically, in the case of Examples 1 to 3 in which each of the axial and circumferential lengths of each exposed surface was set to 1.0 mm to 1.8 mm, the incidence of heater breakage failure was 0.01% or less and the test result was considerably good, irrespective of the outer diameter of the heater set to any of 3.1 mm, 3.3 mm, and 3.5 mm. In contrast, in the case of Comparative Examples 1 to 3 in which each of the axial and circumferential lengths of each exposed surface was greater than 1.8 mm, the incidence of heater breakage failure was high when the heater was thin (the outer diameter was equal to or less than 3.3 mm). This evaluation test revealed that the effect of the present invention becomes more remarkable when the outer diameter of the heater is 3.3 mm or less.

[Checking of Dimensional Ratio of Exposed Surface]

Next, there will be described a test performed for checking the relation (of the incidence of breakage failure) to the axial and circumferential dimensions of the exposed surface of each electrode taking-out portion. The evaluation method is identical to that employed in the above-described test for checking the incidence of breakage failure. In order to check the resistance of the heater to load, the incidence of heater breakage failure was checked with the lubricant removal temperature set to an extremely high temperature of 350° C. Table 4 shows the results of the evaluation. In order to evaluate the relation to the axial and circumferential dimensions of each exposed surface, the dimensions of the exposed surfaces of Examples 4 to 6 were set such that the exposed surfaces had the same area.

TABLE 4

| Relation to dimensional ratio | Heater main portion dimensions (mm) Axial direction | Circumferential direction | Heater outer diameter | Breakage failure |
|---|---|---|---|---|
| Example 4 | 1.7 | 1.0 | 3.1 | BB |
| Example 5 | 1.3 | 1.3 | 3.1 | AA |
| Example 6 | 1.0 | 1.7 | 3.1 | AA |

The glow plug of Example 4 is identical to that of the above-mentioned Example 1 except that the lubricant removal temperature differs from that in Example 1. Whereas no breakage failure occurred in Example 4 in the above-described test for checking the dependency on the heater outer diameter, a breakage failure occurred in Example 4 in the present test in which the lubricant removal temperature was increased excessively. In contrast, no breakage failure occurred in Examples 5 and 6. This result shows that the resistance to breakage failure increases as the shape of the exposed surface changes from that of Example 4 in which the axial dimension of the exposed surface was larger than the circumferential dimension thereof to that of Example 6 in which the axial dimension of the exposed surface was smaller than the circumferential dimension thereof. This result shows the meaningfulness of making the axial dimension of the exposed surface smaller than the circumferential dimension thereof. Conceivably, such a test result was obtained because of the influence of the fact that the tensile stress which is applied to the boundary of the exposed surface of each electrode taking-out portion in the axial direction by the exposed surface depends mainly on the axial dimension of the exposed surface.

Further, there will be examined the relation between the residual stress of the heater and the distance from the boundary of the exposed surface of each electrode taking-out portion in the vicinity of the exposed surface.

[Checking of Influence of Residual Stress]

Since the ceramic heater of the present invention is formed such that the lead portions contain metallic elements in a greater amount as compared with the substrate, the coefficient of thermal expansion of the lead portions is greater than that of the substrate. Therefore, in a cooling step which is performed after firing in a process of manufacturing the heater, the lead portions shrink more than does the substrate, whereby a tensile stress is produced in the substrate. That stress acts as a compressive stress on the surface of the heater (substrate). Since the compressive stress acts, the apparent strength of that portion; i.e., a portion of the substrate where the lead portions are embedded, increases. Meanwhile, at the electrode taking-out portions (exposed surfaces) where the lead portions are exposed, the exposed portions (exposed surfaces) of the lead portions shrink while pulling portions of the substrate around the exposed portions. Therefore, the above-mentioned compressive stress is cancelled out. Namely, at the boundaries between the exposed surface and the substrate, it is difficult to expect the effect of increasing the strength by the above-described compressive stress.

In view of the foregoing, the present invention employs a structure in which the ratio at which the compressive stress is cancelled out is decreased by decreasing the area of each exposed surface. Namely, by decreasing the area of each exposed surface, the strength of the substrate around the exposed surface is increased. This effect becomes more remarkable when the exposed surface has a shape having no corner portion; i.e., a shape similar to a circle or an ellipse, because occurrence of local stress concentration can be avoided.

Figure 4:
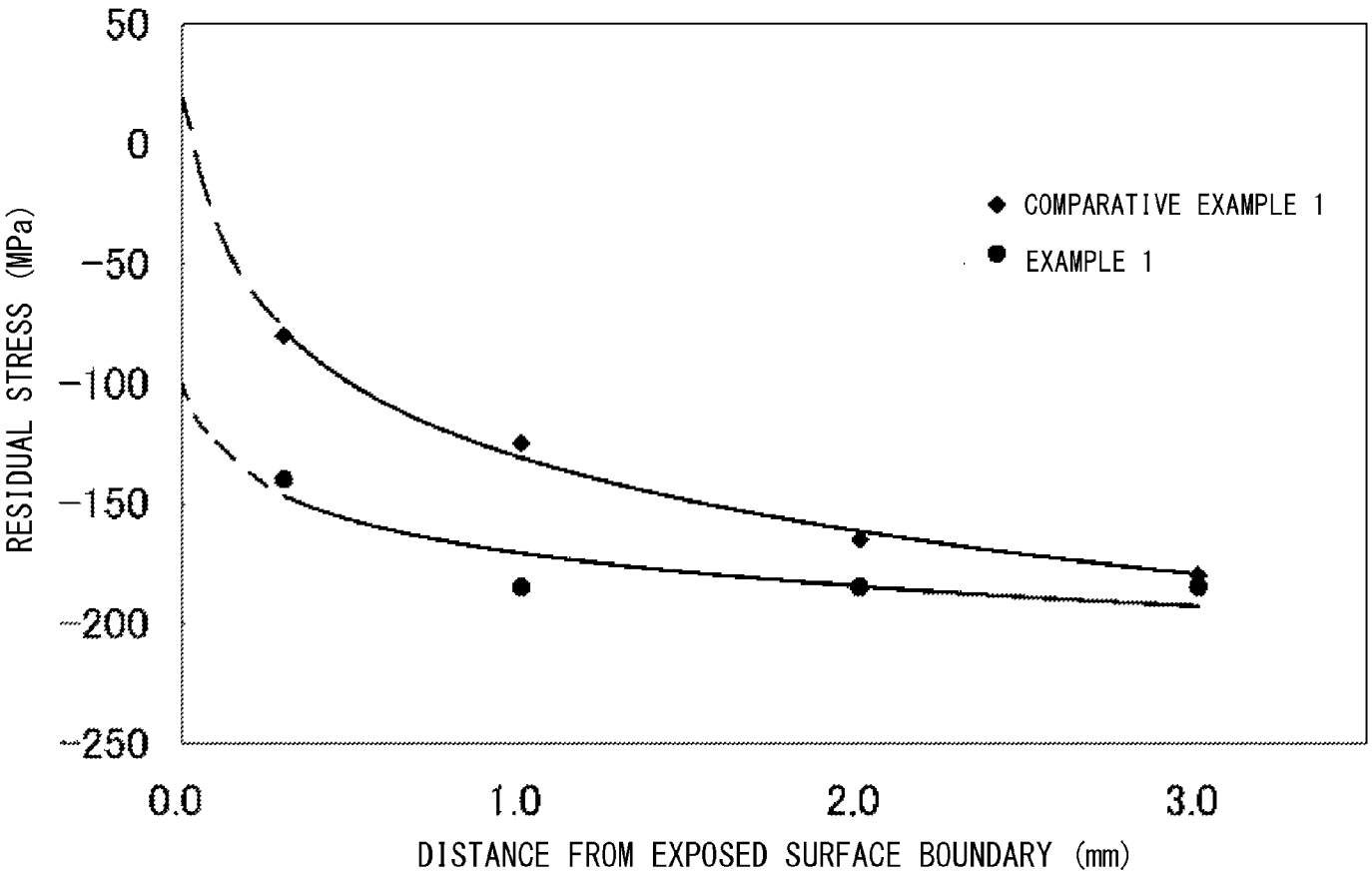
FIG. 4 Graph showing the results of a measurement performed to check the influence of residual stress in the ceramic heater.

A test for confirming the above-described effect was performed. FIG. 4 shows the results of the test.

Figure 5:
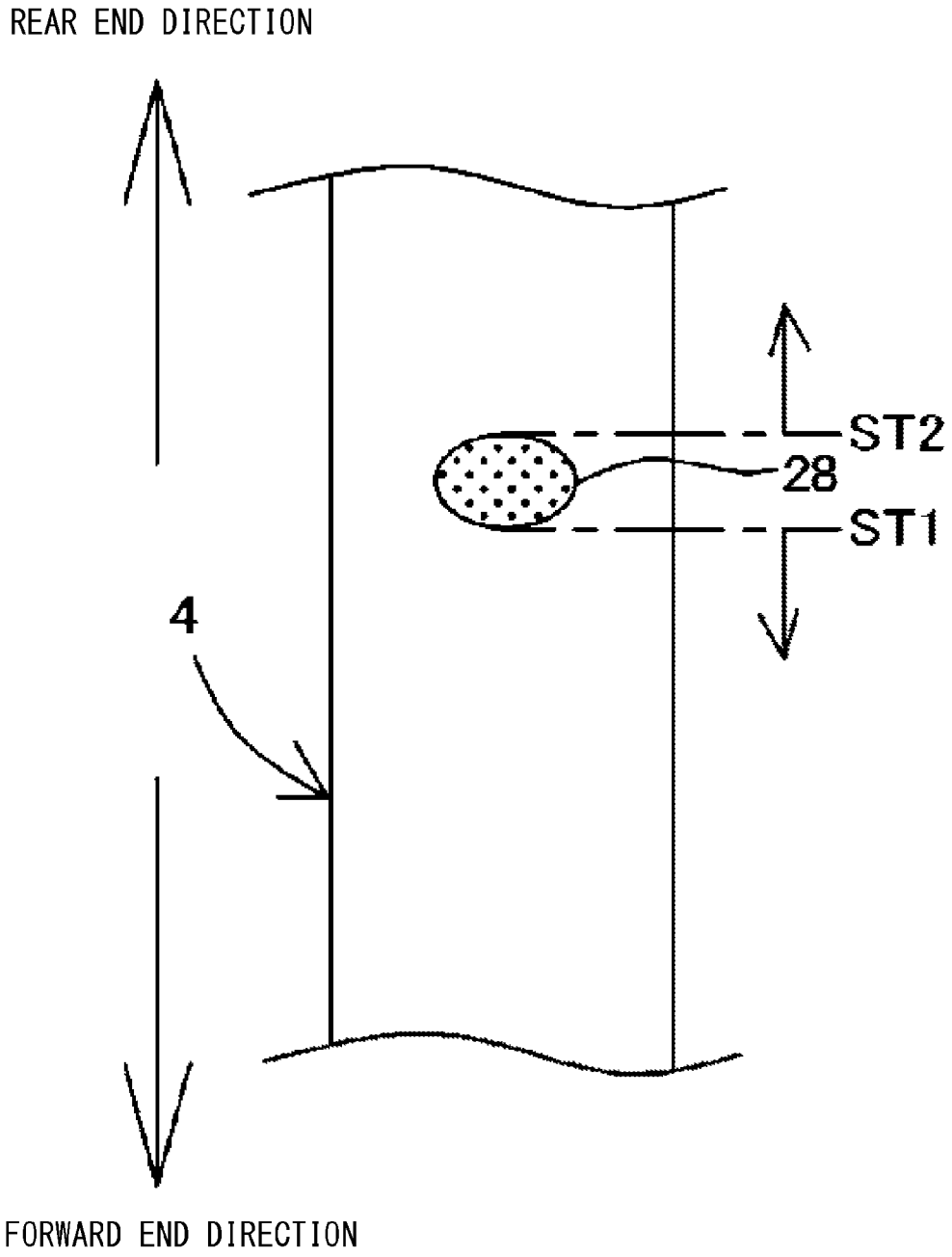
FIG. 5 Explanatory view showing an exposed surface of an electrode taking-out portion, which is a main portion of the present invention, and residual stress measurement regions.

The above-mentioned Example 1 and Comparative Example 1 were used as samples for this evaluation test. For each heater, the surface residual stress of the heater itself was measured. For stress measurement, an X-ray residual stress measurement method and a $2\theta-\sin 2\theta$ method were used. For stress measurement, $\beta$-$Si_3N_4$ (212) which is high in peak intensity on the large angle side (131.55°) was used. A collimator of $\phi$0.5 mm was used, the $2\theta$ sampling width was 0.1°, and the counting time was 1,000 sec. An X-ray tube (Cr—K$\alpha$) was used. In the present method, an X-ray was applied at a plurality of incident angles, and diffraction angles were obtained. A residual stress was calculated from the inclination of a $2\theta-\sin 2\phi$ diagram which was made from the diffraction angles corresponding to the incident angles. The measurement of residual stress was performed at four points each of which was separated by a predetermined distance in the axial direction from base points (see positions ST1 and ST2 in FIG. 5) which are located at the boundary between the substrate and the exposed surface of an electrode taking-out portion.

In order to evaluate the residual stress at the boundary between the substrate and the exposed surface of each electrode taking-out portion, the residual stress at the boundary should be measured. However, when an attempt is made to measure the residual stress at the boundary, there is produced a diffraction peak due to the constituent material of the electrode taking-out portion at the exposed surface, and accurate 2θ measurement cannot be performed. Also, since the side surface of a cylindrical columnar heater having a diameter of about 3.1 mm is measured, if the diameter of the collimator is not greater than 0.5 mm, the peak intensity decreases, and reliable stress measurement cannot be performed. Therefore, as a rough estimate of the residual stress at the boundary, there was measured a residual stress at a position which is separated from the interface by 0.30 mm, which is greater than 0.25 mm (the radius of the collimator), which is the minimum distance required to guarantee that the measurement range contains no electrode material.

The ratio of the compressive residual stress at the exposed surface boundary to that at a lead portion in each sample will be referred to as the "compressive residual stress ratio." The compressive residual stress ratio of Example 1 was 71%, the compressive residual stress ratio of Example 2 was 50%, and the compressive residual stress ratio of Comparative Example 1 was 45%. Here, the lead portion refers to a position which is sufficiently separated from the exposed surface boundary and at which the stress is stable.

Notably, the expression "has (having) no corner portion" used for the shape of the exposed surface of the present invention means that the shape of the exposed surface is not limited to a circle or an ellipse, and may be a generally rectangular shape having corners rounded to have a radius of curvature R. When the radius of curvature R of the rounded corners is 0.1 mm or greater, it can be said that the rectangular shape "has no corner portion."

According to the above-described present invention, the strength of the electrode portions of the ceramic heater can be increased without changing the constituent material of the heater and the dimensions, material, etc. of the outer sleeve. However, the present invention does not restrict changing of the constituent material of the heater and/or various changes of the outer sleeve, and can be employed in any glow plug which is required to increase the strength of the electrode portions of the ceramic heater.

For example, in the above-described embodiment, the ceramic heater 4 is press-fitted into the inner hole of the outer sleeve 5, whereby the ceramic heater 4 is held therein. However, there may be employed a structure in which the ceramic heater is held within the inner hole of the outer sleeve via a brazing material layer.

DESCRIPTION OF REFERENCE NUMERALS

1: ceramic glow plug
2: metallic shell
21: substrate
22: resistor
23, 24: lead portion
25: connecting portion
26: heat-generating portion
3: center shaft
4: ceramic heater
5: outer sleeve

The invention claimed is:

1. A ceramic glow plug comprising:

a ceramic heater composed of a substrate formed of an electrically insulating ceramic and having a columnar shape extending in an axial direction, and a resistor having a heat-generating element formed of an electrically conductive ceramic, embedded in a forward end portion of the substrate, and generating heat by resistance heating when energized, lead portions connected to opposite end portions of the heat-generating element and extending rearward in the axial direction, and an electrode taking-out portion extending in a radial direction from at least one of the lead portions and exposed on an outer circumferential surface of the substrate; and a metallic tubular member in which the ceramic heater is held and which is in contact with an exposed surface of the electrode taking-out portion and electrically conducts with the exposed surface, the ceramic glow plug being characterized in that dimensions, in the axial and circumferential directions, of the exposed surface of the electrode taking-out portion both fall within a range of 1.0 mm to 1.8 mm, wherein the ratios of compressive residual stress in each of a specific region of the substrate which is 0.3 mm forward in the axial direction from a forward end of the exposed surface of the electrode taking-out portion and a specific region of the substrate which is 0.3 mm rearward in the axial direction from a rear end of the exposed surface to a compressive residual stress in a portion of the substrate other than the specific regions are 50% or higher.

2. The ceramic glow plug according to claim 1, wherein the dimension of the exposed surface of the electrode taking-out portion measured in the axial direction is smaller than that measured in the circumferential direction.

3. The ceramic glow plug according to claim 1, wherein the shape of the exposed surface of the electrode taking-out portion does not have corner portions.

4. The ceramic glow plug according to claim 1, wherein the ceramic heater is press-fitted into the tubular member.

* * * * *